United States Patent [19]

Menchetti

[11] Patent Number: 4,870,794

[45] Date of Patent: Oct. 3, 1989

[54] CLIP FOR OUTWARDLY OPENING C-STUD

[75] Inventor: Robert J. Menchetti, Buffalo, N.Y.

[73] Assignee: National Gypsum Company, Dallas, Tex.

[21] Appl. No.: 281,619

[22] Filed: Dec. 9, 1988

[51] Int. Cl.[4] ..... E04B 2/00

[52] U.S. Cl. ..... 52/281; 52/481; 52/489

[58] Field of Search ..... 52/489, 484, 357, 701, 52/281, 481, 378, 379, 710, 235

[56] References Cited

U.S. PATENT DOCUMENTS

| | | | |
|---|---|---|---|
| 2,116,737 | 5/1938 | Urbain | 52/482 X |
| 3,234,702 | 2/1966 | Zibell | 52/379 X |
| 3,266,209 | 8/1966 | Zibell | 52/487 X |
| 3,918,230 | 11/1975 | Carroll | 52/357 X |
| 4,481,749 | 11/1984 | Stirling | 52/489 X |
| 4,567,706 | 2/1986 | Wendt | 52/481 X |
| 4,708,554 | 11/1987 | Howard | 52/710 X |

*Primary Examiner*—David A. Scherbel
*Assistant Examiner*—Lan Mai
*Attorney, Agent, or Firm*—Laird F. Miller; Robert F. Hause

[57] ABSTRACT

A clip for permitting attachment of wallboard to the open side of an outwardly opening C-shaped metal stud, including a clip body portion which engages three sides of the metal stud for increased stability, and a clip hanger portion which extends upwardly and inwardly through the stud open front side and has tabs which engage behind the flanges of the stud open front side.

11 Claims, 2 Drawing Sheets

CLIP FOR OUTWARDLY OPENING C-STUD

BACKGROUND OF THE INVENTION

This invention relates to a sheet metal clip for affixing vertical edges of wallboard to the open side of an outwardly opening C-stud.

A problem has existed in attaching wallboard to a metal stud in a wall framing system which uses outwardly opening C-shaped vertical studs. An outwardly opening C-stud is a four-sided stud which includes three solid sides and one open side. The one open side has flanges along each edge of the open side and a wide opening therebetween. By "outwardly opening" it is meant that the open side of the stud is one of the two sides against which wallboard is to be affixed. This outwardly opening C-stud is to be distinguished from the common C-shaped metal screw stud which is intended for screw application of wallboard to two opposed solid sides, with only one solid web disposed perpendicular to the two screw flanges. The outwardly opening C-stud has two solid webs disposed perpendicular to the plane of the wallboards, to be affixed thereto.

The flanges along each edge of the open side of an outwardly opening C-stud do not provide enough surface area for screw attachment of wallboard thereto, creating the problem in attaching wallboards to outwardly opening C-studs, referred to above.

U.S. Pat. No. 3,266,209 discloses outwardly opening C-shaped metal struts which provide anchoring means for attaching kerfed or grooved marble slabs as facings for a wall. Anchor members attach the slabs to the struts. The anchor members, several embodiments are shown, all include a web portion which spaces the slabs from the struts, a kerf engaging portion on the end of the web, and a strut engaging portion. The strut engaging portions include bolted connections, outwardly struck spring elements which, with adjacent short arms, grasp the strut flanges and T-shaped extrusions which slidingly engage the strut flanges, all of which strut engaging portions are ree to rotate relative to the strut.

U.S. Pat. No. 2,116,737 discloses a clip for attaching wooden floorboards to an upwardly opening channel member, employing metal clips which rest on the bottom wall of the channel and protrude out of the top opening and engage the edges of the floorboards. These clips are free to rotate relative to the channel.

SUMMARY OF THE INVENTION

The present invention is directed to a novel clip for attachment of wallboards to the open side of an outwardly opening C-shaped metal stud. The clip includes a channel shaped body portion which extends across the open side of the C-stud and extends, further, around onto the two sides of the stud adjoining the outwardly opening open side. The clip further includes an upwardly and inwardly directed hanger portion which is shaped to fit between the stud open side flanges with a widened upper end which provides tabs which engage immediately behind the stud open side flanges.

The clip also includes sidewardly bent upper corners on the body portion for ease of engagement of the body portion with the stud.

The central part of the body portion can be a plane flat section of sheet metal to which wallboard is screw attached, using self-drilling, self-threaded wallboard screws, or it can be formed with outwardly protruding pointed legs for penetrating the edge of the wallboard.

The clip is easily combined with the stud, by inserting the widened upper end into the interior of the stud, through the stud opening, rotating the clip to position the widened end tabs behind the stud flanges, and then rotating the clip about a horizontal axis to position the body portion around the three sides of the stud, at which time the bent upper corners facilitate the positioning.

It is an object of the invention to provide an improved clip for affixing wallboard to outwardly opening C-studs.

It is a further object to provide a clip for outwardly opening C-studs having improved ease of affixation of the clip to the stud.

It is a still further object to provide outwardly opening C-studs clips having an instantly grasping body position which prevents clip rotation once wallboard is affixed to the clip.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
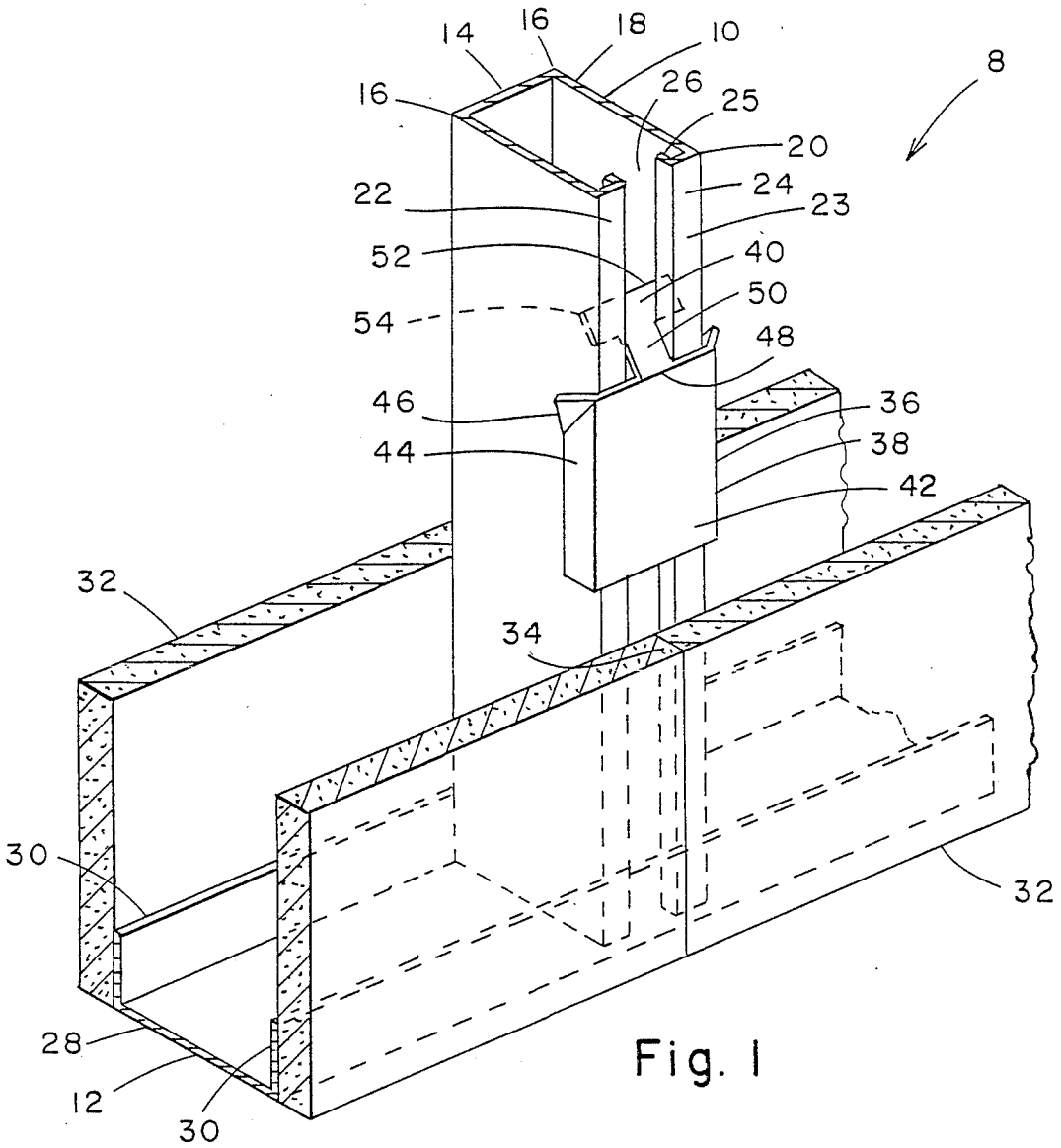
FIG. 1 is an isometric view of an outwardly opening vertical C-stud with a novel C-stud clip for attachment of wallboard to the stud open side.
Figure 2:
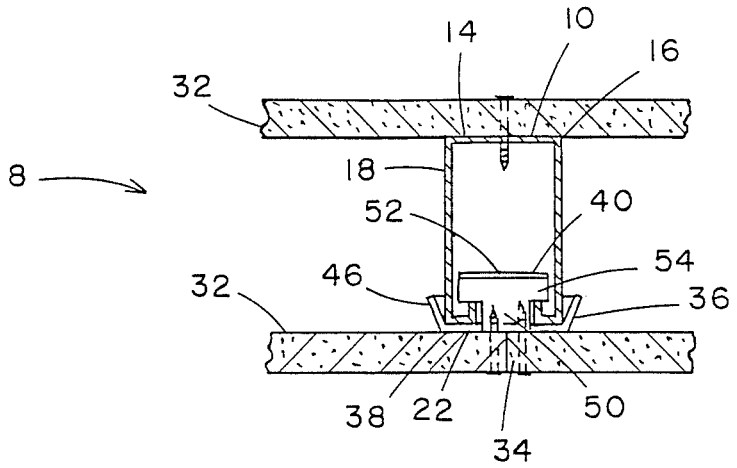
FIG. 2 is a plan view of the stud and clip of FIG. 1, with wallboard attached to the C-stud clip.

Referring to FIGS. 1 and 2, there is shown a portion of a wall 8 including one of several vertically disposed, spaced apart, outwardly opening, C-shaped, elongate metal studs 10, mounted in a horizontal extending floor runner 12. Stud 10 includes an elongate back face 14 terminating along each back corner 16 with a perpendicularly disposed, elongate side web portion 18, each having a front corner 20 with a pair of elongate, front flanges 22, each extending from a front corner 20 toward the opposite flange 22, on the open front side 23 of stud 10. The flanges 22 include elongate, narrow face portions 24 and inwardly directed, elongate, narrow stiffening lips 25. Between the respective flanges 22 is an elongate opening 26.

Floor runner 12 has an elongate base 28 and two upwardly extending, elongate side walls 30. The side walls 30 of floor runner 12 engage the back face 14 of stud 10 and the front flanges 22.

It will be seen that stud 10 is thus disposed in floor runner 12 such that wallboard 32 is affixed against the back face 14 and the face portions 24 of front flanges 22. One wallboard 32 is screw attached directly to back face 14. The edges 34 of two other wallboards 32 are screw attached to a novel C-stud clip 36, which clip 36 is affixed to the open front side 23 of stud 10.

C-stud clip 36 is formed from sheet metal and includes a channel shaped body portion 38 and an upwardly and inwardly directed hanger portion 40.

Body portion 38 includes a central face portion 42 and two rearwardly directed, narrow side portions 44 which extend around the front corners 20 and along a narrow part of the web portions 18. The upper rearward corner 46 of each side portion 44 is bent sidewardly away from the stud web portion 18.

Hanger portion 40 is adjoined to body portion 38 along a horizontal fold line 48. Hanger portion 40 includes a narrow neck 50 and a wide upper end 52, forming tabs 54 which are disposed immediately behind the stud flanges 24 and lips 25. Hanger portion 40 is originally formed at a slight angle to, or in substantially the same plane as, the face portion 42 of body portion 38 and becomes bent considerably inwardly, along fold line 48, when body portion 38 is placed against the stud open front side 23, at a final angle of between about 20° and 80°.

Tabs 54 are thus urged firmly against the inner surface of flanges 22, providing a relatively firm grasp of the stud 10 by each clip 36, by the tendency of the clip to return to its original relatively coplanar relationship of hanger portion 40 and face portion 42.

Placement of clips 36 on a stud 10 consists of the steps of holding the clip 36 with the two tabs 54 directed vertically, respectively upwardly and downwardly, then inserting the hanger portion 40 through the opening 26, then rotating the clip to where the two tabs 54 are directed horizontally and disposed inwardly of flanges 22, and then rotating the clip about a horizontal axis to bring the face portion 42 firmly against the stud face portions 24. In so doing, the channel shaped body portion 38 will engage the stud on three sides, the open front side 23 and the two web portions 18. The placement of the side portions 44 against web portions 18 will be facilitated by the sidewardly bent corners 46, which will guide the body portion 38 into proper position.

The disposition of the body portion 38, engaging three sides of the stud 10 will be seen to provide a more stable relationship between clip 36 and stud 10.

Figure 3:
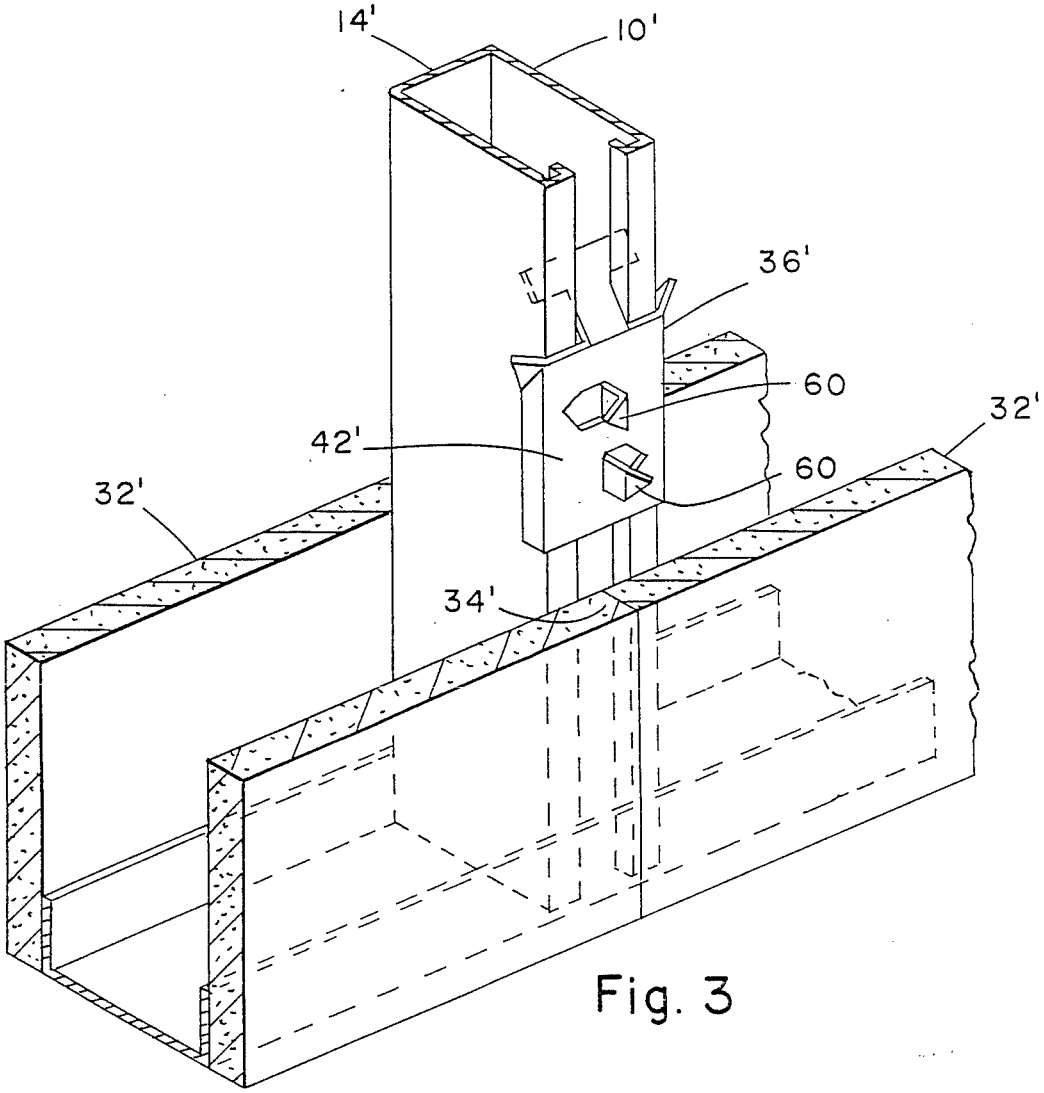
FIG. 3 is an isometric view, similar to FIG. 1, of an outwardly opening C-stud with a modified form of C-stud clip for attachment of wallboard to the stud open side.
Figure 4:
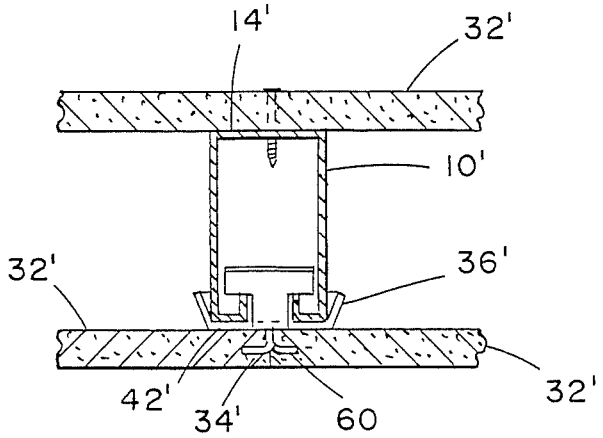
FIG. 4 is a plan view of the stud and clip of FIG. 3, with wallboard attached to the C-stud clip.

Referring to FIGS. 3 and 4, a modified form of clip 36' is shown in which the face portion 42' further includes a pair of oppositely directed, outwardly protruding, pointed legs 60. Wallboard 32' is screw attached to the back face 14' of stud 10' and the edges 34' of two other wallboards 32' held against the stud 10' by the pointed legs 60 being inserted into the edges 34'.

Having completed a detailed disclosure of the preferred embodiments of my invention so that those skilled in the art may practice the same, I contemplate that variations may be made without departing from the essence of the invention.

I claim

1. In combination, an outwardly opening C-shaped metal stud and a wallboard attachment clip, said stud comprising an elongate back wall, a pair of perpendicularly directed elongate web portions and an open front side, said open front side having a pair of elongate opposed flanges with an elongate opening between said opposed flanges, said wallboard attachment clip comprising a channel shaped body portion and a hanger portion, said body portion including a face portion extending across said stud open front side and a pair of rearwardly directed narrow side portions which extend from said face portion rearwardly along a portion of said stud web portion, said hanger portion including a narrow neck and a wide upper end, said upper end having tabs disposed inwardly of said stud flanges, said hanger portion beinq adjoined to said face portion along a fold line, said hanger portion being inwardly bent along said fold line relative to the plane of said face portion at an angle of between about 20° and 80° and having a spring-like tendency to return to a lesser angle, whereby said flanges are grasped by said tabs.

2. The combination of claim 1 wherein said clip face portion is an uninterrupted section of screwable sheet metal.

3. The combination of claim 1 wherein said clip face portion includes at least one outwardly protruding pointed leg.

4. The combination of claim 1 wherein said clip face portion includes a pair of oppositely directed, outwardly protruding pointed legs.

5. The combination of claim 1 wherein said stud flanges include narrow face portions and inwardly directed stiffening lips.

6. The combination of claim 1 wherein said narrow side portions each have a sidewardly bent upper corner.

7. A hollow partition wall comprising the combination of an outwardly opening C-shaped metal stud and a wallboard attachment clip as defined in claim 1, said metal stud being one of a plurality of similar, horizontally spaced apart, outwardly opening, C-shaped metal studs disposed in a floor runner and extending upwardly therefrom, said wall further comprising wallboard affixed to said clip face portion of a plurality of said clips and thereby held against the open front side of said C-shaped metal studs.

8. A hollow partition wall as defined in claim 7 wherein said wallboard is screw attached to said clip face portion of said clips.

9. A hollow partition wall as defined in claim 7 wherein said clips each have a clip face portion which includes a pair of oppositely directed, outwardly protruding pointed legs, and said wallboard is attached to said clip face portion by said pointed legs protruding into edges of said wallboard.

10. A hollow partition as defined in claim 7 wherein said stud flanges include narrow face portions and inwardly directed stiffening lips.

11. A hollow partition as defined in claim 7 wherein said clip narrow side portions each have a sidewardly bent upper corner.

* * * * *